United States Patent [19]

Ferket et al.

[11] 4,388,816

[45] Jun. 21, 1983

[54] METHOD AND APPARATUS FOR ROLLING A LENGTH OF METAL BAR OR WIRE

[75] Inventors: Florimond Ferket, Oudorp; Cornelis A. Kuenen, Heerhugowaard, both of Netherlands

[73] Assignee: Estel Hoogovens B.V., IJmuiden, Netherlands

[21] Appl. No.: 226,944

[22] Filed: Jan. 21, 1981

[51] Int. Cl.[3] ..... B21B 37/00; B21B 45/02

[52] U.S. Cl. ..... 72/11; 72/14; 72/201

[58] Field of Search ..... 72/13, 14, 201, 205, 72/11, 19, 31

[56] References Cited

FOREIGN PATENT DOCUMENTS 967071 10/1957 Fed. Rep. of Germany .
2539422 3/1976 Fed. Rep. of Germany .
2004405 11/1969 France .
2389436 12/1978 France .
932587 7/1963 United Kingdom .
1162859 8/1969 United Kingdom .

*Primary Examiner*—Ervin M. Combs
*Attorney, Agent, or Firm*—Jon M. Lewis

[57] ABSTRACT

At the end of a hot-rolling train, a metal length (bar or wire) is passed through a final roll stand and then through a cooling device. To keep the length under tension in the cooling device, it is pulled frictionally by an opposed pair of bridle rolls which are driven, while the length is passing, with a power input which would, in the absence of the length, be sufficient to cause a peripheral speed of the bridle rolls slightly higher than the rolling speed of the length. To prevent the leading end of the metal length being twisted or otherwise damaged on entry into the bridle rolls, the bridle rolls are driven at a slightly higher peripheral speed immediately prior to the entry of the metal length.

5 Claims, 2 Drawing Figures

METHOD AND APPARATUS FOR ROLLING A LENGTH OF METAL BAR OR WIRE

BACKGROUND OF THE INVENTION

1. FIELD OF THE INVENTION

This invention relates to a method of rolling a length of metal bar or wire, especially hot-rolled bar or wire, and is particularly concerned with the steps necessary to keep such a metal length stretched at the end of rolling when it passes through a cooling device after the final roll stand. The invention also relates to apparatus for carrying out the method. For ease of description, the metal length will generally be called a bar in the following description, but is not limited thereto.

2. DESCRIPTION OF THE PRIOR ART

It is known to keep a "continuous" metal bar or wire, which is passing through a finishing roll stand and subsequently through a cooling device, stretched by means of a set of bridle rolls (also known as pinch rolls) located after the cooling device, between which the bar is frictionally gripped. Typically the bridle rolls are driven by independent identical motors with a rated peripheral velocity exceeding the finishing rolling speed of the bar. See Dutch Pat. No. 154129, which discloses use of an adjustable parallelogram-shaped yoke in a plane at right angles to the passage of the bar, the yoke being supported by two fixed pivots above and below the rolls. The rolls turn in bearings in the upstanding sides of the parallelogram-shaped yoke. The motors are fitted in the said upstanding sides.

In practice, it has been found that, possibly owing to the large inertial mass involved, the first part of the bar becomes twisted or buckled in the cooling device. This is apparently caused by some difficulty of entry of the leading end of the bar into the bridle rolls, or some slippage in the grip of the bridle rolls, and occurs notwithstanding the slightly higher speed of the bridle rolls at entry of the bar. This higher speed arises from the power input to the motors of the rolls which is selected so that the rolls exert a drawing on the bar to keep it under tension. Bar ends damaged in this way have to be scrapped, which is costly.

SUMMARY OF THE INVENTION

The object of the present invention is to avoid this disadvantage.

According to the invention, the power input to the bridle rolls is temporarily increased, so that, immediately before entry of the bar into the bridle rolls, their peripheral speed is greater than the peripheral speed corresponding to the normal power input used during passage of the bar. For instance the power input is briefly increased as the leading end of the bar approaches, so that the bridle rolls are rotating at the higher speed at the moment of entry. Thereafter, or even before the moment of entry, the power input is reduced to the level used while the bar is passing. It appears that the extra peripheral speed of the bridle rolls causes a considerably greater tensile force on the bar as the bar begins to pass through them, and this greater force virtually eliminates twisting or buckling of the head of the bar.

Preferably the bridle rolls are driven independently by permanently fitted motors by means of Cardan shafts, but a single drive to the two rolls is possible.

In order to obtain a good grip on the bar material, the gap between the bridle rolls before entry of the bar should preferably be about 2 mm smaller than the thickness of the bar concerned.

Since a certain amount of time is required to increase the speed of the bridle to the higher level, it is preferred that the approach of the leading end of the hot-rolled bar towards the finishing roll stand is observed optically, to provide an electric signal which is used to cause the temporary increase in power input.

BRIEF INTRODUCTION OF THE DRAWINGS

An embodiment of the invention will now be described by way of example and with reference to the accompanying drawing.

DESCRIPTION OF THE PREFERRED EMBODIMENT

Figure 1:
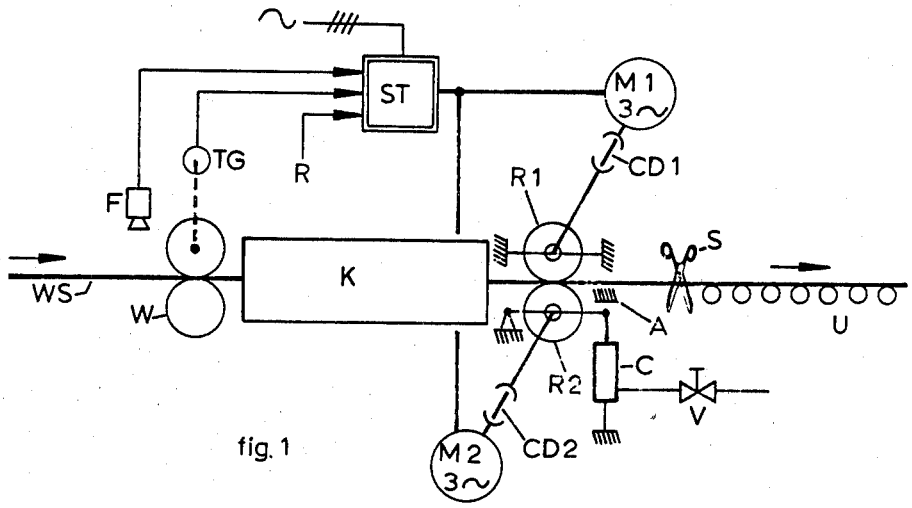
FIG. 1 is a diagrammatic side view of a finishing roll stand, cooling device, bridle rolls, shear and run-out table, to which the method according to the invention is applied.

In FIG. 1 is shown part of a mill train for the hot-rolling of bar and wire material WS. The finishing roll stand W is followed by a cooling device K, and by a pair of bridle rolls R1 and R2, between which the "continuous" bar is frictionally gripped, relatively lightly. S indicates a shear and U the run-out table or cooling bank for the material which is cut to measure by the shear.

The bridle rolls R1 and R2 are driven independently through Cardan shafts CD1 and CD2 by permanently fitted electric motors M1 and M2, which are supplied from a static frequency convertor ST. In one practical embodiment, the motors M1 and M2 are squirrel-cage rotor motors rated at 3.75 kVA each and the static frequency convertor has an output of 15 kVA with a yield of 90%. The convertor ST receives signals from a photo electric cell F which detects the presence of the hot bar material in the mill train before the finishing stand W, the cell being located above the mill train before the stand W. The convertor also receives signals from a tachogenerator TG which determines the finishing rolling speed, being linked to the finishing stand W. Data are also entered, indicated by R in FIG. 1 relating to the diameter correlation and the drawing adjustment for the bar being rolled.

FIG. 1 shows, highly diagrammatically, that the upper bridle roll R1 is fixed while the bottom bridle roll R2 is movable since the frame in which the roll R2 is fitted can swing round a pivot located "upstream" with respect to the bar travel. An adjustable stop A determines the minimum gap between the two rolls R1 and R2. This gap is set at about 2 mm less than the thickness or diameter of the bar to be drawn. An air cylinder C, supplied from a compressed air network through a reducing valve V, normally presses the frame in which the roll R2 is fitted against the stop A (whose position is adjustable by means of a screw spindle). As soon as the bar arrives between the rolls R1 and R2, the frame leaves the stop and the air cylinder C ensures that the bar is spring gripped between the two rolls.

The gripping surface of the two rolls is profiled, e.g. by applying a pattern of recesses or holes and then hardened. When changing the rolls, e.g. because of wear or to change to another diameter of roll, the top roll R1 can be placed in the correct position in the rolling line by adjusting the frame carrying it.

Figure 2:
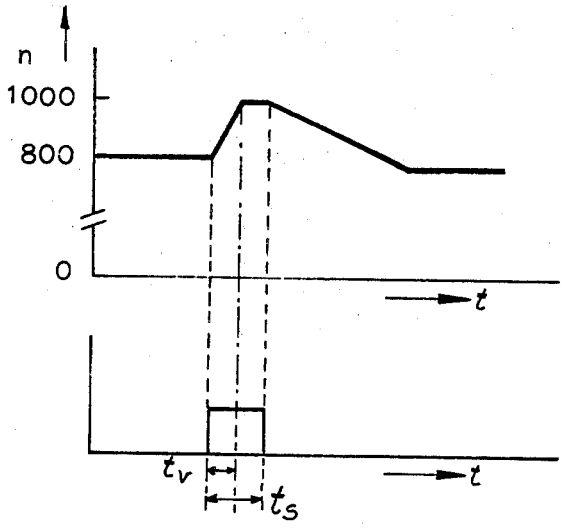
FIG. 2 is a double graph to clarify the operation of the method.

FIG. 2 shows how a temporary accumulation of energy can be used to keep the bar stretched when entering the bridle rolls. Time is indicated along the horizontal axis. In the upper graph, the rotational speed n(rpm) of the bridle rolls is given on the vertical axis, and in the lower graph the control signal to the bridle roll motors is shown on the vertical axis. This control signal indicates the period of time for which a higher power input is applied. Power input can be accurately controlled by means of the static frequency convertor ST, using frequency control of the motors.

FIG. 2 thus shows that there is a temporary increase in the power input over a time period $t_s$ which leads (see the upper graph) to an acceleration of the bridle rolls to a higher speed, this acceleration occurring over a time period of $t_v$. The initial speed of the bridle rolls (given as 800 rpm in this example) is the idling speed of the rolls at the normal power input which is used when the bar is actually passing; this idling speed is 5 to 10% higher than the actual rolling speed of the bar. When the bar is passing, the bridle rolls must of course run at a peripheral speed equal to the rolling speed of the final roll stand W, as indicated by the slightly lower speed (e.g. 760 rpm) at the right hand side of FIG. 2.

As mentioned above, when the approach of the leading end of the bar is signalled, the power input to the bridle roll motors is increased, leading to a rise in speed of about 25% in this case (to about 1000 rpm). This rise is synchronised so that the leading end of the bar arrives after the higher speed is reached. In this case, the moment of arrival of the bar corresponds with the end of the time period $t_s$ and is followed by the decline in speed to the level corresponding to the final rolling speed. It is this initial tension applied to the bar which minimises the damage to the head of the bar. This leads to a considerable reduction in wastage of material.

A 25% increase in speed is indicated above (to 1000 from 800). Suitably, this increase is in the range 15% to 35%.

The time $t_s$ during which the control signal is present is not fixed, nor is the time $t_v$ over which the rotating parts are speeded up. Both depend on, inter alia the speed of the bar material. The time $t_s$ is adjusted in dependence on the roll speed (via TG) automatically in ST.

There is a linear correlation between the supply frequency and the rotational speed n of the squirrel-cage rotor motor under zero load. As the frequency is briefly increased, the speed of the drive motors M1 and M2 rises from, in this example, 800 to 1000 rpm. As a result, more rotational energy is accumulated in the rotating parts, i.e. the rotors of the motors M1 and M2, the Cardan shafts CD1 and CD2 and the rolls R1 and R2.

If the photo-electric cell F is located at a distance of about 7 meters from the bridle rolls R1, R2, and the speed of the bar is about 14 meters per second, 0.5 seconds is available to increase the speed. On entering the rolls R1, R2, the head of the bar will be subjected to a considerable tensile force between the rolls owing to the difference in the speed between these rolls and the stand W, so that the head of the bar will remain straight.

Because also the gap between the rolls at the time of entry of the bar is about 2 mm less than the diameter of the bar, there is less slip on entry between the bridle rolls and the bar material, so that there is an additional advantage that the bridle rolls last longer.

What is claimed is:

1. An improved method of rolling a length of metal bar or wire of the type where the metal length is passed through a roll stand and subsequently through at least one cooling device and then through an opposed pair of driven bridle rolls, and is maintained under tension in the cooling device by said bridle rolls which frictionally grip the metal length between them and which are driven, during passage of the metal length, with a power input which, if the metal length were absent, would cause the bridle rolls to rotate at a first peripheral speed of the bridle rolls higher than the rolling speed of the metal length in the roll stand, wherein the improvement comprises:

rotating the bridle rolls at a second peripheral speed higher than said first peripheral speed at the moment when the leading end of the metal length reaches the bridle rolls.

2. A method according to claim 1 further comprising passing plural metal lengths serially through said roll stand, cooling device and bridle rolls at periodic intervals, driving said bridle rolls during the portion of said intervals at which no metal length is passing through said bridle rolls at said power input corresponding to said first peripheral speed and, immediately prior to the leading end of a metal length reaching said bridle rolls, transitorily increasing the power input so as to cause the bridle roll speed to rise to said second peripheral speed.

3. A method according to claim 1 further comprising setting a gap between the bridle rolls, prior to said metal length being inserted between said bridle rolls, at a spacing of about 2 mm less than the thickness of the metal length.

4. A method according to claim 1 further comprising detecting by optical means the approach of the leading end of the metal length to the roll-stand, generating an output signal corresponding to said detection, and actuating in response to said output signal a rise in the speed of the bridle rolls to said second peripheral speed.

5. Apparatus for carrying out the method of claim 4 said apparatus comprising a roll stand, a cooling device and an opposed pair of bridle rolls arranged in series, and also having drive motors for the bridle rolls in the form of squirrel-cage rotor motors supplied by a static frequency convertor, a photo-electric cell arranged to detect the presence of a hot metal length approaching the roll stand and to provide an indicative first output signal, and a tacho-generator linked to the roll stand to determine the rolling speed therein of the metal length and to provide a second indicative output signal, and means for directing said indicative output signals from the cell and tachogenerator to the frequency convertor for controlling the rotational speed of motors in dependence on the output signals so as to rotate said bridle rolls, upon said leading edge of said metal length reaching said bridle rolls, at said second peripheral speed higher than said first peripheral speed.

* * * * *